US011333163B2

(12) United States Patent
Adachi

(10) Patent No.: US 11,333,163 B2
(45) Date of Patent: May 17, 2022

(54) ELECTRIC BLOWER, ELECTRIC VACUUM CLEANER, AND HAND DRYER

(71) Applicant: Mitsubishi Electric Corporation, Tokyo (JP)

(72) Inventor: Naho Adachi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 895 days.

(21) Appl. No.: 16/091,748

(22) PCT Filed: May 25, 2016

(86) PCT No.: PCT/JP2016/065495
§ 371 (c)(1),
(2) Date: Oct. 5, 2018

(87) PCT Pub. No.: WO2017/203641
PCT Pub. Date: Nov. 30, 2017

(65) Prior Publication Data
US 2019/0154054 A1 May 23, 2019

(51) Int. Cl.
*F04D 29/66* (2006.01)
*F04D 29/30* (2006.01)
(Continued)

(52) U.S. Cl.
CPC ..... *F04D 29/30* (2013.01); *F04D 25/06* (2013.01); *F04D 25/082* (2013.01);
(Continued)

(58) Field of Classification Search
CPC ..... F04D 29/30; F04D 29/282; F04D 29/444; F04D 29/666; F04D 25/086
See application file for complete search history.

(56) References Cited

U.S. PATENT DOCUMENTS

2012/0189454 A1 7/2012 Iwakiri et al.
2015/0003966 A1* 1/2015 Duquette ..... F04D 29/281 415/119

FOREIGN PATENT DOCUMENTS

JP 2004-044473 A 2/2004
JP 2004044473 A * 2/2004
(Continued)

OTHER PUBLICATIONS

International Search Report of the International Searching Authority dated Aug. 30, 2016 for the corresponding international application No. PCT/JP2016/065495 (and English translation).

*Primary Examiner* — Sabbir Hasan
(74) *Attorney, Agent, or Firm* — Posz Law Group, PLC

(57) ABSTRACT

Provided is an electric blower configured to include a centrifugal impeller provided with an intermediate blade, which reduces pressure loss inside an air path on a large air volume side and achieves high efficiency. In the electric blower, a first rotor blade and a second rotor blade each include an inner circumferential edge facing a central portion of a hub and connecting an upper edge and a lower edge. The inner circumferential edge of the second rotor blade includes a first portion connected to the lower edge, a second portion connected to the upper edge, and a third portion. The third portion is located between the first portion and the second portion. Among the first portion, the second portion, and the third portion, the first portion is located closest to an outer circumferential portion of the hub in a direction along a surface portion.

5 Claims, 6 Drawing Sheets

(51) Int. Cl.

| | |
|---|---|
| ***F04D 25/08*** | (2006.01) |
| ***F04D 25/06*** | (2006.01) |
| ***F04D 29/28*** | (2006.01) |
| ***F04D 29/44*** | (2006.01) |

(52) U.S. Cl.
CPC ..... *F04D 29/282* (2013.01); *F04D 29/444* (2013.01); *F04D 29/666* (2013.01); *F04D 25/086* (2013.01); *F05D 2240/304* (2013.01)

(56) References Cited

FOREIGN PATENT DOCUMENTS

| | | | | |
|---|---|---|---|---|
| JP | 2011-080411 | A | | 4/2011 |
| JP | 2013099396 | A | * | 5/2013 |
| JP | 2014055568 | A | * | 3/2014 |

* cited by examiner

ELECTRIC BLOWER, ELECTRIC VACUUM CLEANER, AND HAND DRYER

CROSS REFERENCE TO RELATED APPLICATION

This application is a U.S. national stage application of International Application PCT/JP2016/065495, filed on May 25, 2016, the contents of which are incorporated herein by reference.

TECHNICAL FIELD

The present invention relates to an electric blower, an electric vacuum cleaner, and a hand dryer.

BACKGROUND

Conventionally, electric blowers used for an electric vacuum cleaner and a hand dryer have been known. For example, Japanese Patent Laying-Open No. 2004-044473 (PTD 1) discloses an electric blower comprising a centrifugal impeller including a conical hub including a curved surface portion, a plurality of main blades located in a circumferential direction on the hub, and intermediate blades located between the main blades, the hub, the main blades, and the intermediate blades being joined to the centrifugal impeller. In the electric blower, the axial height of each intermediate blade is lower than the axial height of each main blade. In addition, in the electric blower, for higher efficiency, inner circumferential edges of the intermediate blades are inclined toward upstream to increase the downstream component of a secondary flow from the main blades. According to PTD 1, internal loss can be reduced by adopting such a configuration.

Patent Document

PTD 1: Japanese Patent Laying-Open No. 2004-044473

In recent years, electrical apparatuses such as an electric vacuum cleaner and a hand dryer have been increasingly required to achieve reduction in size and weight. Accordingly, individual components used for the electric vacuum cleaner and the like have also been required to achieve reduction in size and weight. An electric blower, which is one of such components, has also been required to have a centrifugal impeller having a smaller outer diameter.

A centrifugal impeller having a small diameter may adopt intermediate blades for higher efficiency. In a case where the intermediate blades are located in this manner, since the number of blades is increased, an air flow inside the centrifugal impeller is improved and efficiency is enhanced on a small air volume side of an air path between the blades. On the other hand, on a large air volume side, the area of the air path between the blades is reduced by placing the intermediate blades, and thereby pressure loss inside the air path is increased, resulting in a reduced efficiency of the entire electric blower.

SUMMARY

The present invention has been made to solve the aforementioned problem, and an object of the present invention is to provide an electric blower configured to include a centrifugal impeller provided with an intermediate blade, which reduces pressure loss inside an air path on a large air volume side and achieves high efficiency, and an electric vacuum cleaner and a hand dryer equipped with the same.

An electric blower in accordance with the present invention includes a centrifugal impeller, an electric motor unit, and a fan cover. The centrifugal impeller includes a hub and a plurality of rotor blades. The electric motor unit is configured to rotate the centrifugal impeller. The hub has a circular outer shape in plan view. The hub includes a central portion protruding in a direction of a rotational axis of the centrifugal impeller, and a surface portion inclined from the central portion toward an outer circumferential portion of the hub. The plurality of rotor blades include a first rotor blade and a second rotor blade. The first rotor blade is joined to the surface portion of the hub. The second rotor blade is provided apart from the first rotor blade in a circumferential direction of the hub, and is joined to the surface portion. The fan cover is located outside the plurality of rotor blades in the direction of the rotational axis of the centrifugal impeller to cover the centrifugal impeller. The first rotor blade and the second rotor blade each include a lower edge joined to the surface portion of the hub, an upper edge facing the fan cover, and an inner circumferential edge connecting the upper edge and the lower edge. A distance from the inner circumferential edge of the second rotor blade to the outer circumferential portion of the hub is shorter than a distance from the inner circumferential edge of the first rotor blade to the outer circumferential portion of the hub, in a direction along the surface portion. The inner circumferential edge of the second rotor blade includes a first portion connected to the lower edge, a second portion connected to the upper edge, and a third portion. The third portion is located between the first portion and the second portion, and protrudes toward the central portion more than the first portion and the second portion. Among the first portion, the second portion, and the third portion, the first portion is located closest to the outer circumferential portion of the hub in the direction along the surface portion.

According to the electric blower in accordance with the present invention, in the inner circumferential edge of the second rotor blade serving as an intermediate blade provided in the centrifugal impeller, the first portion located on a surface portion side of the hub is located closer to the outer circumferential portion of the hub than the second portion and the third portion, in the direction along the surface portion of the hub. Thus, a reduction in the area of an air path between the first rotor blades serving as main blades can be suppressed in particular on an inner circumferential side (an air intake port side) of the first rotor blades, when compared with a case where the first portion is located closer to the central portion of the hub than the second portion and the third portion. Accordingly, pressure loss inside the air path in particular on a large air volume side can be reduced. As a result, a highly efficient electric blower can be obtained.

DETAILED DESCRIPTION

Figure 1:
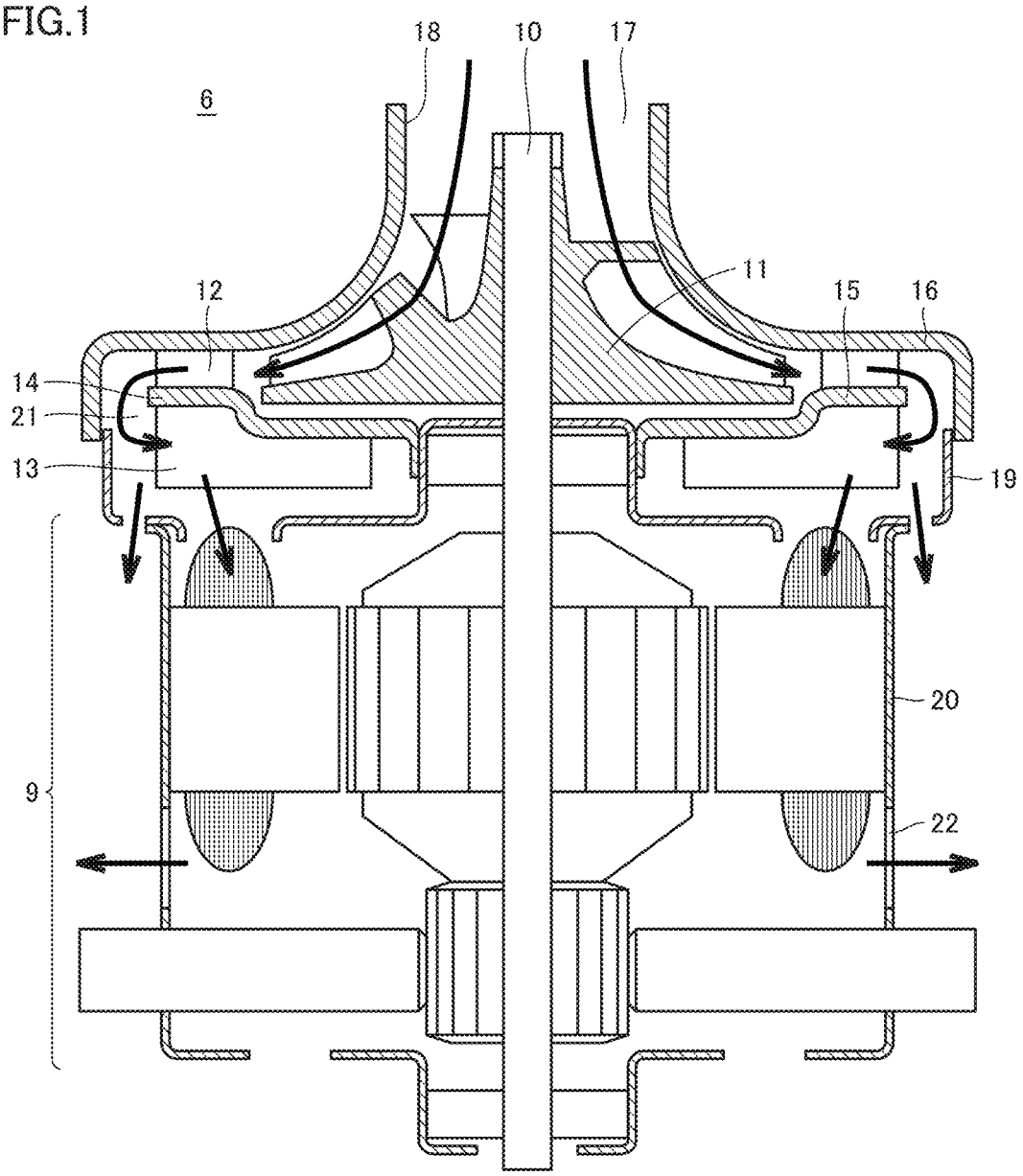
FIG. 1 is a schematic cross sectional view of an electric blower in accordance with the present embodiment.

Hereinafter, an embodiment of the present invention will be described with reference to the drawings. It should be noted that identical or corresponding parts in the drawings below will be designated by the same reference numerals, and the description thereof will not be repeated.

<Configuration of Electric Blower in Accordance with Present Embodiment>

Figure 2:
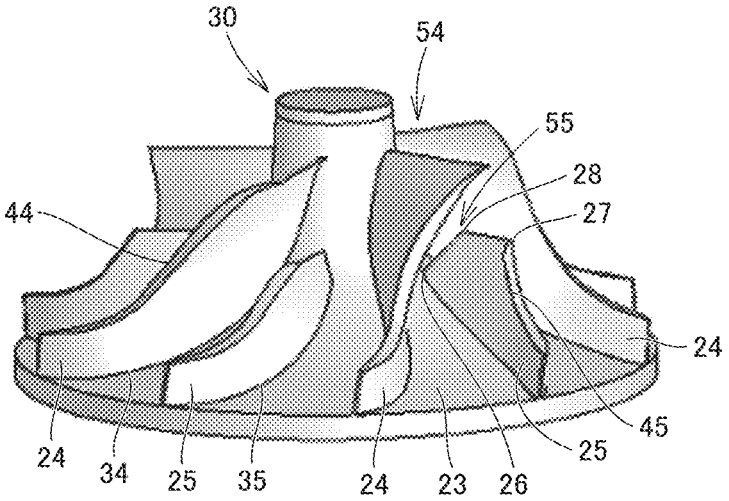
FIG. 2 is a schematic perspective view showing a centrifugal impeller of the electric blower shown in FIG. 1.
Figure 3:
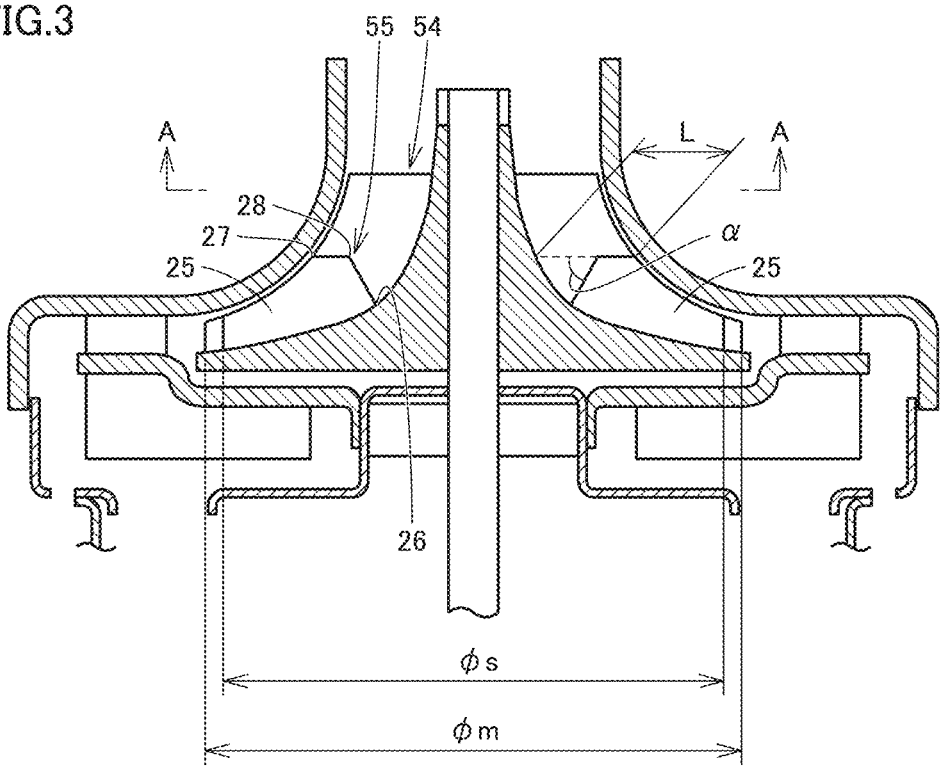
FIG. 3 is a schematic partial cross sectional view of the electric blower shown in FIG. 1.
Figure 4:
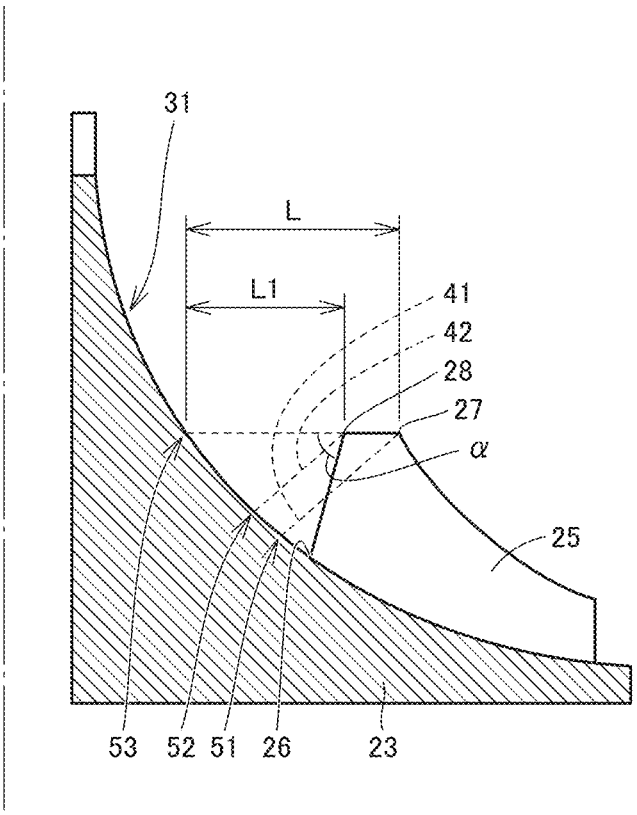
FIG. 4 is an enlarged schematic partial cross sectional view of the electric blower shown in FIG. 1.

An electric blower shown in FIGS. 1 to 4 is an electric blower in accordance with the present embodiment, and is used for an electrical apparatus such as an electric vacuum cleaner or a hand dryer. FIG. 1 is a schematic cross sectional view in a vertical direction of the electric blower in accordance with the embodiment of the present invention. In FIG. 1, arrows indicate an air flow. FIG. 2 is a schematic perspective view showing a centrifugal impeller of the electric blower shown in FIG. 1. FIG. 3 is a schematic partial cross sectional view in the vertical direction showing a portion of the electric blower shown in FIG. 1. FIG. 4 is an enlarged schematic partial cross sectional view in the vertical direction showing a portion of the centrifugal impeller constituting the electric blower shown in FIG. 1.

As shown in FIGS. 1 to 4, the electric blower in accordance with the embodiment of the present invention includes a centrifugal impeller 11, an electric motor unit 9, and a fan cover 16. Centrifugal impeller 11 includes a hub 23 and a plurality of rotor blades. Electric motor unit 9 rotates centrifugal impeller 11 via a shaft 10. Hub 23 has a planar shape having a circular outer shape. Hub 23 includes a central portion 30 protruding in a direction of a rotational axis of centrifugal impeller 11, and a surface portion 31 inclined from central portion 30 toward an outer circumferential portion. The plurality of rotor blades include at least one first rotor blade 24 serving as a main blade, and at least one second rotor blade 25 serving as an intermediate blade. In FIGS. 1 to 4, a plurality of first rotor blades 24 and a plurality of second rotor blades 25 are formed. The plurality of first rotor blades 24 are provided to be apart from each other in a circumferential direction of hub 23, and are joined to surface portion 31 of hub 23. The plurality of second rotor blades 25 are provided between the plurality of first rotor blades 24, and are joined to surface portion 31. That is, second rotor blade 25 is provided apart from first rotor blade 24 in the circumferential direction of hub 23. The plurality of first rotor blades 24 and the plurality of second rotor blades 25 are provided alternately in the circumferential direction of hub 23. From a different viewpoint, centrifugal impeller 11 includes substantially conical hub 23, first rotor blades 24, and second rotor blades 25. The plurality of first rotor blades 24 are provided in the circumferential direction, and are joined to hub 23. Second rotor blade 25 is provided between first rotor blades 24 to be joined to hub 23. Second rotor blade 25 is an intermediate blade whose axial height is lower than that of the main blade (first rotor blade 24).

Each of the plurality of first rotor blades 24 and the plurality of second rotor blades 25 includes a lower edge 34, 35 joined to surface portion 31 of hub 23, an upper edge 44, 45 facing fan cover 16, and an inner circumferential edge 54, 55 connecting upper edge 44, 45 and lower edge 34, 35. In a direction along surface portion 31, a distance from inner circumferential edge 55 of second rotor blade 25 to the outer circumferential portion of hub 23 is shorter than a distance from inner circumferential edge 54 of first rotor blade 24 to the outer circumferential portion of hub 23. The length of lower edge 34 of each of the plurality of first rotor blades 24 is longer than the length of lower edge 35 of each of the plurality of second rotor blades 25. Fan cover 16 is located outside the rotor blades (first rotor blades 24 and second rotor blades 25) in the direction of the rotational axis of centrifugal impeller 11 to cover centrifugal impeller 11 and stator vanes 12 in a diffuser 15. In a central portion of fan cover 16, a bell mouth 18 defining an opening is provided at a position facing a suction port 17 of centrifugal impeller 11.

At a side surface of an electric blower 6, a bracket 19 joined to fan cover 16 to cover return stator vanes 13 is provided. In addition, below bracket 19, a motor frame 20 joined to bracket 19 to cover electric motor unit 9 is provided. Motor frame 20 is provided with several discharge holes 22 through which air passing through centrifugal impeller 11, diffuser 15, and electric motor unit 9 is discharged.

Between fan cover 16 and diffuser 15, a gap 21 serving as a flow path from stator vanes 12 toward return stator vanes 13 is provided. Diffuser 15 has a main plate 14 which joins stator vanes 12 and return stator vanes 13.

Inner circumferential edge 55 of each of the plurality of second rotor blades 25 includes a first portion 26 connected to lower edge 35, a second portion 27 connected to upper edge 45, and a third portion 28. Third portion 28 is located between first portion 26 and second portion 27. Third portion 28 protrudes most toward central portion 30 in inner circumferential edge 55. From a different viewpoint, third portion 28 protrudes toward central portion 30 more than first portion 26 and second portion 27. Among first portion 26, second portion 27, and third portion 28, first portion 26 is located closest to the outer circumferential portion of hub 23 in the direction along surface portion 31. Further, from a different viewpoint, first portion 26 is provided more downstream than second portion 27 and third portion 28 in an air flow direction indicated by the arrows in FIG. 1.

In addition, from a different viewpoint, the shape of inner circumferential edge 55 of second rotor blade 25 described above can be specified as follows. Specifically, as shown in FIG. 4, when a perpendicular 41 extending from second portion 27 toward surface portion 31 of hub 23 is considered, an intersection point of perpendicular 41 and surface portion 31 is defined as a point 51. Further, when a perpendicular 42 extending from third portion 28 toward surface portion 31 of hub 23 is considered, an intersection point of perpendicular 42 and surface portion 31 is defined as a point 52. In this case, as shown in FIG. 4, first portion 26 is located closer to the outer circumference of hub 23 than point 51 and point 52.

In electric blower 6 described above, as shown in FIG. 4, in a direction perpendicular to a rotational axis of centrifugal impeller 11, a distance L1 from third portion 28 to surface portion 31 may be more than or equal to 0.7 times and less than or equal to 0.8 times a distance L from second portion 27 to surface portion 31. More preferably, distance L1 described above is 0.75 times distance L. Here, as shown in FIG. 4, a line segment perpendicular to the rotational axis is drawn from third portion 28, and a point 53 which is an intersection point of the line segment and surface portion 31 is considered. A distance between point 53 and third portion 28 is distance L1 described above. Further, a line segment perpendicular to the rotational axis is drawn from second portion 27, and an intersection point of the line segment and surface portion 31 is considered. A distance between the intersection point and second portion 27 is distance L described above.

In electric blower 6 described above, as shown in FIGS. 3 and 4, an angle α formed between a line segment connecting first portion 26 and third portion 28 and a plane perpendicular to the rotational axis is less than 90°. That is, as shown in FIG. 4, angle α formed between a line segment connecting point 53 and third portion 28 and the line segment connecting first portion 26 and third portion 28 is less than 90°. In addition, in electric blower 6 described above, as shown in FIG. 3, in a radial direction perpendicular to the rotational axis, outermost circumferential portions of the plurality of first rotor blades 24 are located outside outermost circumferential portions of the plurality of second rotor blades 25. Further, from a different viewpoint, as shown in FIG. 3, an outer diameter ϕs of second rotor blades 25 is provided, in the relation with an outer diameter ϕm of first rotor blades 24, to satisfy ϕs<ϕm.

<Function/Effect of Electric Blower>

In a case where second rotor blades 25 serving as intermediate blades are applied to centrifugal impeller 11 in electric blower 6 which is required to have a smaller diameter, for example, an air flow inside centrifugal impeller 11 is improved and efficiency is enhanced on a small air volume side of an air path. On the other hand, since the number of rotor blades is increased, a distance between the rotor blades on a hub 23 side becomes narrow in particular. Thus, the area of the air path between the rotor blades is reduced. Accordingly, on a large air volume side of the air path, pressure loss inside the air path may be increased and efficiency may be reduced. However, in inner circumferential edge 55 (front edge) of second rotor blade 25 serving as an intermediate blade in the present embodiment, first portion 26 serving as a first front edge is provided more downstream in the air flow direction than second portion 27 serving as a second front edge and third portion 28 serving as a third front edge. Thus, a region in which the distance between the blades on the hub 23 side becomes narrow can be relatively decreased. As a result, a reduction in the area of the air path between the blades is suppressed in particular on an inner circumferential side of the rotor blades, and thus air can be efficiently blown on a second portion 27 side of second rotor blade 25. Thereby, a highly efficient electric blower having a low pressure loss inside an air path can be obtained.

In addition, since distance L1 from third portion 28 to surface portion 31 is more than or equal to 0.7 times and less than or equal to 0.8 times distance L from second portion 27 to surface portion 31 as described above, a region in which the inner circumferential edge of second rotor blade 25 does not exist and thus the area of the air path between the blades is not reduced can be sufficiently increased. Accordingly, pressure loss inside the air path can be reliably reduced.

Figure 5:
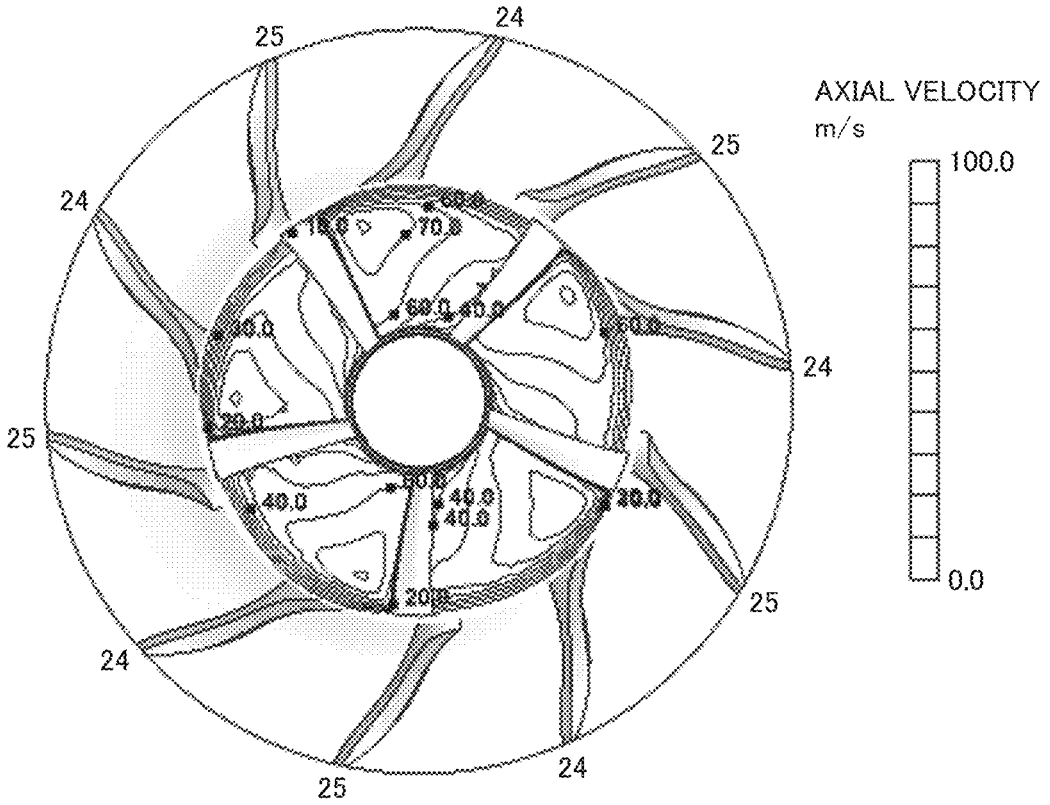
FIG. 5 is a schematic view showing axial velocity distribution in the centrifugal impeller in a cross section along a line segment A-A in FIG. 3.

For example, FIG. 5 is a schematic view showing axial velocity distribution on an entrance side of centrifugal impeller 11. FIG. 5 shows the axial velocity distribution in a cross section along a line segment A-A in FIG. 3. Here, the product of axial velocity and air path horizontal cross sectional area represents an air volume passing between the rotor blades. FIG. 5 shows that the passing air volume is large on an outer circumferential side. In addition, in electric blower 6 in accordance with the present embodiment, the area of the air path between the rotor blades is maintained on the inner circumferential side, as described above. On the other hand, at a position on the outer circumferential side where the passing air volume is large, second portion 27 and third portion 28 of second rotor blade 25 are provided more upstream in the flow direction than the inner circumferential side. Thus, the air flow between the rotor blades can be efficiently guided to an exit of centrifugal impeller 11. Thereby, electric blower 6 which can reduce pressure loss inside the air path between the rotor blades on the large air volume side and achieve high efficiency as a result can be obtained.

In addition, in electric blower 6 described above, since angle α at the inner circumferential edge in second rotor blade 25 is less than 90° as shown in FIGS. 3 and 4, the area of a connection portion between second rotor blade 25 and hub 23 can be fully secured. Thus, even when a high load is applied to second rotor blade 25, occurrence of a problem that the connection portion between hub 23 and second rotor blade 25 may be broken can be suppressed. As a result, a highly efficient electric blower which can be operated for a long period of time can be obtained.

Here, generally, as a major factor of noise when operating electric blower 6, there is rotor blade/stator vane interference noise caused by interference between a flow blown from centrifugal impeller 11 and stator vanes 12 provided in the outer circumference of centrifugal impeller 11. In the case where second rotor blades 25 serving as intermediate blades are applied to centrifugal impeller 11, the number of rotor blades is increased, and the rotor blade/stator vane interference noise is also increased. However, in centrifugal impeller 11 of the present embodiment, the rotor blade/stator vane interference noise can be reduced, because outer diameter ϕs of second rotor blades 25 is smaller than outer diameter ϕm of first rotor blades 24 serving as main blades. Accordingly, low-noise electric blower 6 can be obtained.

<Configuration of Electric Vacuum Cleaner in Accordance with Present Embodiment>

Figure 6:
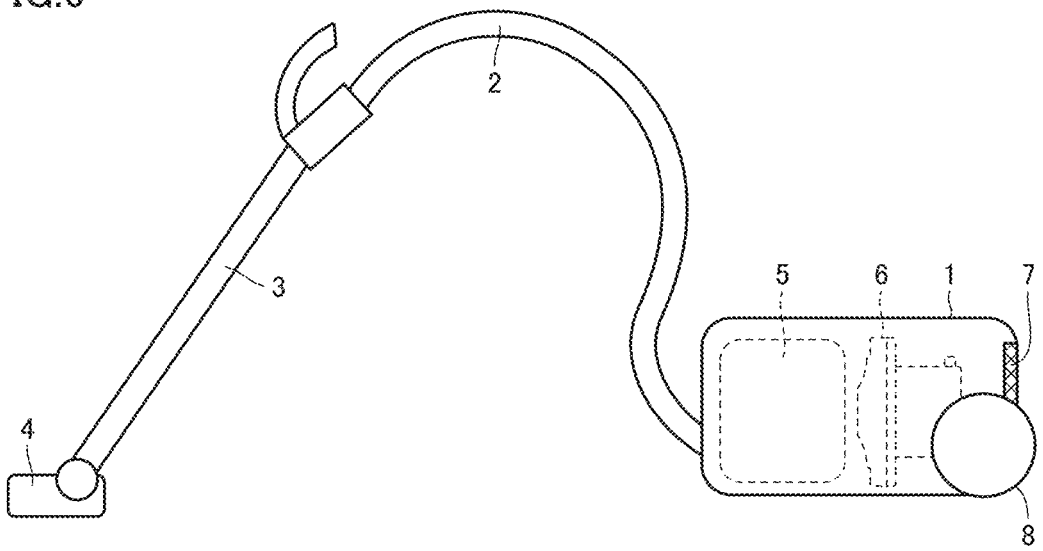
FIG. 6 is a schematic view showing an electric vacuum cleaner in accordance with the present embodiment.

FIG. 6 is a schematic view of an electric vacuum cleaner in accordance with the embodiment of the present invention. In FIG. 6, the electric vacuum cleaner includes an electric vacuum cleaner main body 1, a suction tool 4, a dust collecting portion 5, and electric blower 6 described above. An exhaust port 7 is provided in electric vacuum cleaner main body 1. Suction tool 4 is joined to electric vacuum cleaner main body 1 using a hose 2 and an extension pipe 3 serving as a pipe line to suck air in a portion to be cleaned. Hose 2 is connected to electric vacuum cleaner main body 1. Extension pipe 3 is connected to a tip side of hose 2. Suction tool 4 is connected to a tip portion of extension pipe 3.

Dust collecting portion 5 is provided inside electric vacuum cleaner main body 1, is in communication with suction tool 4, and stores dust in the sucked air. Electric blower 6 is provided inside electric vacuum cleaner main body 1 to suck the air from suction tool 4 into dust collecting portion 5. Electric blower 6 is the electric blower in accordance with the embodiment of the present invention described above. Exhaust port 7 is provided at the back of electric vacuum cleaner main body 1 to exhaust the air subjected to dust collection by dust collecting portion 5 out of electric vacuum cleaner main body 1.

At the sides of electric vacuum cleaner main body 1, rear wheels 8 are placed backward in a traveling direction. At a lower portion of electric vacuum cleaner main body 1, a front wheel (not shown) is provided forward in the traveling direction.

<Operation and Function/Effect of Electric Vacuum Cleaner in Accordance with Present Embodiment>

Next, operation of the electric vacuum cleaner will be described.

In the electric vacuum cleaner configured as described above, shaft 10 (see FIG. 1) is rotated when electric power is supplied to electric motor unit 9 (see FIG. 1) of electric blower 6. As shown in FIG. 1, by the rotation of shaft 10, centrifugal impeller 11 fixed to shaft 10 is rotated to suck air through suction port 17. Thereby, the air on a surface to be cleaned is sucked into electric vacuum cleaner main body 1 through hose 2, extension pipe 3, and suction tool 4 joined to electric vacuum cleaner main body 1 shown in FIG. 6. The air sucked into electric vacuum cleaner main body 1 is subjected to dust collection in dust collecting portion 5.

Then, the air exhausted from dust collecting portion 5 passes through bell mouth 18 of electric blower 6 and is sucked through suction port 17 of centrifugal impeller 11 as shown in FIG. 1. The air sucked into centrifugal impeller 11 is pressurized and accelerated by centrifugal impeller 11, and is directed radially outward while swirling. Most of the air discharged from centrifugal impeller 11 is decelerated and pressurized between stator vanes 12 in diffuser 15. Then, the air passes through gap 21 between diffuser 15 and fan cover 16. Furthermore, the air is guided toward electric motor unit 9 by return stator vanes 13 to cool electric motor unit 9. Thereafter, the air is exhausted through discharge holes 22 provided in motor frame 20 to the outside of the electric blower. Then, the air is exhausted through exhaust port 7 provided in vacuum cleaner main body 1 shown in FIG. 6 to the outside of electric vacuum cleaner main body 1.

In the electric vacuum cleaner described above, since electric blower 6 in accordance with the present embodiment described above is used, an electric vacuum cleaner which can reduce pressure loss inside an air path between rotor blades and achieve high efficiency and a long life as a result can be obtained.

It should be noted that, although the case where electric blower 6 of the present embodiment is mounted in a canister-type electric vacuum cleaner in which hose 2 and extension pipe 3 are joined to electric vacuum cleaner main body 1 has been described, electric blower 6 is also applicable to other types of electric vacuum cleaners. For example, electric blower 6 described above is also applicable to a cordless-type electric vacuum cleaner or a stick-type electric vacuum cleaner in which an extension pipe is connected to an electric vacuum cleaner main body.

<Configuration and Function/Effect of Hand Dryer in Accordance with Present Embodiment>

Figure 7:
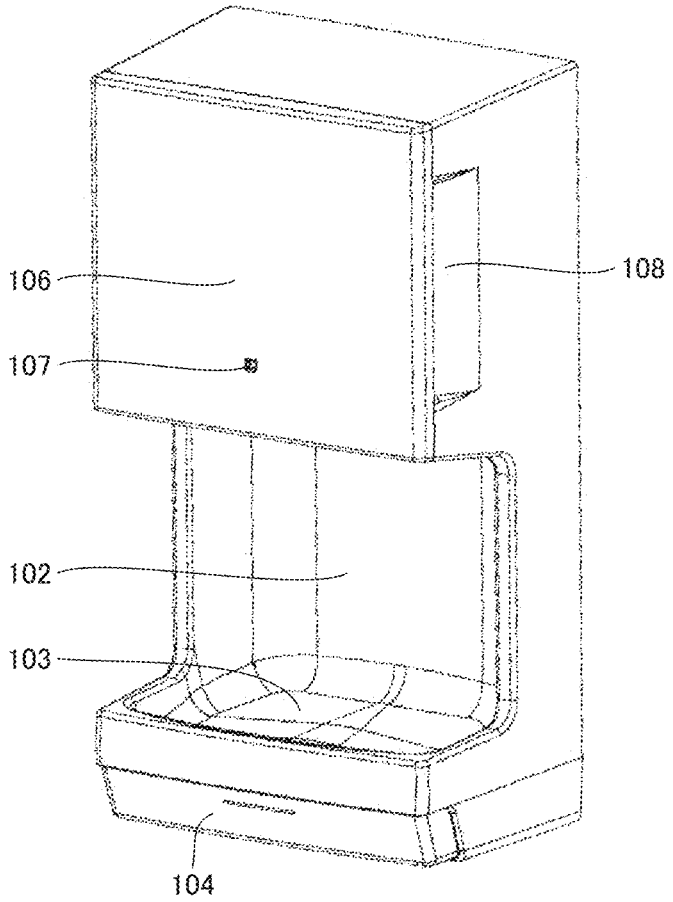
FIG. 7 is a schematic perspective view of a hand dryer in accordance with the present embodiment.
Figure 8:
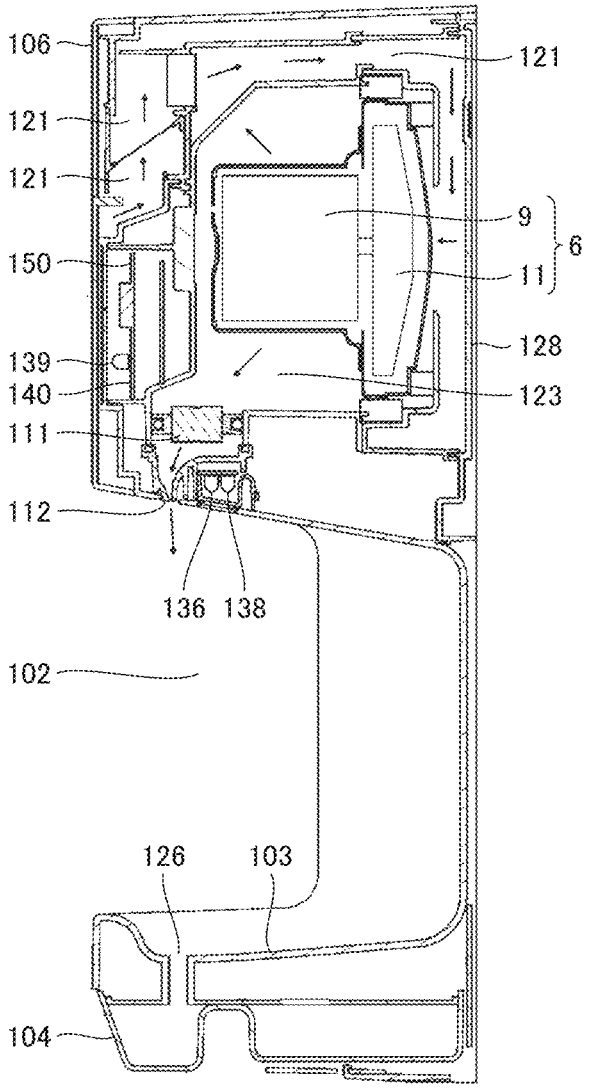
FIG. 8 is a schematic cross sectional view of the hand dryer shown in FIG. 7.

A hand dryer in accordance with the present embodiment shown in FIGS. 7 and 8 includes a casing 106 serving as a main body, a hand insertion portion 102, a water receiving portion 103, a drain receptacle 104, a light transmission window 107, and air inlets 108. The hand dryer has electric blower 6 inside casing 106. In the hand dryer, hands are inserted into hand insertion portion 102 above water receiving portion 103, and water is blown off from the hands by air blown by electric blower 6. The blown-off water is stored into drain receptacle 104 through water receiving portion 103.

As shown in FIGS. 7 and 8, casing 106 constituting an outer shell of the hand dryer has a hand insertion opening in a front surface. Casing 106 includes hand insertion portion 102 as a process space adjacent to the hand insertion opening. A user can insert hands into hand insertion portion 102. Hand insertion portion 102 is formed in a lower portion of the front surface of casing 106, as a recess in the shape of an open sink in which a front surface and both side surfaces are opened. Water receiving portion 103 is located to form a lower portion of hand insertion portion 102. As shown in FIG. 8, the bottom of water receiving portion 103 is inclined downward toward the front, and a drain outlet 126 is provided at an inclined lower end thereof. Below water receiving portion 103, drain receptacle 104 for storing the water dripping from drain outlet 126 is provided to be removable. In an upper portion of hand insertion portion 102, a nozzle 112 for blowing high-speed air downward toward hand insertion portion 102 is provided.

Inside a box-like space above hand insertion portion 102 formed by casing 106 and a base 128 constituting the outer shell of the hand dryer on a back surface side, electric blower 6 is located, including electric motor unit 9, which is an AC motor serving as a commutator motor, and a turbo fan, which is centrifugal impeller 11 that is fixed to the rotational axis of electric motor unit 9 and is rotated. Electric blower 6 is driven, for example, by electric power supplied from outside, or by electric power from a power supply such as a battery located inside casing 106. In addition, inside the box-like space, there are provided an intake air path 121 establishing communication between an intake air side of electric blower 6 and air inlets 108 provided in side surfaces of casing 106, and an exhaust air path 123 establishing communication between an exhaust air side of electric blower 6 and nozzle 112.

In exhaust air path 123, in the vicinity of an upstream side of nozzle 112, a heater 111 for heating the air sent from electric blower 6 to produce warm air is provided. Inside casing 106, at a position closer to the back surface side than nozzle 112 serving as an air outlet, there is provided a circuit substrate including a hand detection sensor 136 and an illumination LED 138. The light emitting direction and the light receiving direction of hand detection sensor 136, and the light emitting direction of illumination LED 138 are all provided toward hand insertion portion 102. Through a light transmission window for transmitting visible light and infrared rays provided in a portion of casing 106 at an upper surface of hand insertion portion 102, hand detection sensor 136 detects the presence or absence of hands in hand insertion portion 102. When it is detected that hands are inserted in hand insertion portion 102, illumination LED 138 serving as illumination means brightly illuminates hand insertion portion 102.

In addition, inside casing 106, in the vicinity of the front surface of casing 106, there is provided a circuit substrate 140 including a control circuit 150, an energization LED 139 serving as energization indicating means which indicates, by lighting, that the hand dryer is powered on and is energized in a standby state, and a selector switch serving as switching means capable of independently switching on and off of lighting of each of illumination LED 138 and energization LED 139. The light emitting direction of energization LED 139 and an operation surface of the selector switch are provided toward the front surface. In addition, light transmission window 107 is provided in casing 106 such that light of energization LED 139 can be visually recognized from the outside of casing 106.

<Operation of Hand Dryer in Accordance with Present Embodiment>

Next, operation of the hand dryer when it is used to dry hands will be described. When a power switch of an electrical apparatus serving as the hand dryer is turned on, control circuit 150 and the like located inside casing 106 are energized, and the hand dryer enters an available state in which the hand dryer can dry hands (hereinafter referred to as a standby state). In addition, when control circuit 150 is energized, illumination LED 138 lights up if illumination LED 138 is switched on by the selector switch, and energization LED 139 lights up if energization LED 139 is switched on by the selector switch. Then, when the user inserts wet hands to close to wrists through the hand insertion opening into hand insertion portion 102, insertion of the hands is detected by hand detection sensor 136. As a result, the electric blower is actuated by control circuit 150.

When electric blower 6 is actuated, air outside the hand dryer is sucked through air inlets 108 provided in the both side surfaces of casing 106. The air sucked through air inlets 108 passes through intake air path 121, passes above electric blower 6, and is directed to the back surface side. Then, the air moves downward and is sucked from a suction side of electric blower 6. Electric blower 6 converts the air sucked from the intake air side into high-pressure air and exhausts it from the exhaust air side. The exhausted high-pressure air passes through exhaust air path 123 and reaches nozzle 112, and is converted into a high-speed air flow having a high kinetic energy. The high-speed air flow is blown downward from nozzle 112 into hand insertion portion 102. The high-speed air flow blown from nozzle 112 impinges on the wet hands inserted in hand insertion portion 102, and removes and blows off moisture on the hands from surfaces of the hands. Thereby, the hands can be dried. It should be noted that, when a heater switch (not shown) provided inside casing 106 is turned on, heater 111 is energized, and the high-pressure air passing through exhaust air path 123 is heated. Thus, warm air is blown from nozzle 112, and thereby the user can use the hand dryer with a comfortable feeling even during the winter season and the like.

When the user removes the hands from hand insertion portion 102 after the hand drying process is finished, hand detection sensor 136 detects the removal of the hands, and the electric blower stops. Water droplets blown off from the hands flow down toward drain outlet 126 in water receiving portion 103 having a forwardly inclined structure, and are stored into drain receptacle 104 through drain outlet 126.

In the hand dryer described above, since electric blower 6 in accordance with the present embodiment described above is used, a hand dryer which can reduce pressure loss inside an air path between rotor blades and achieve high efficiency and a long life as a result can be obtained.

Although the embodiment of the present invention has been explained as described above, it is also possible to modify the embodiment described above in a various manner. In addition, the scope of the present invention is not limited to the embodiment described above. The scope of the present invention is defined by the scope of the claims, and is intended to include any modifications within the scope and meaning equivalent to the scope of the claims.

INDUSTRIAL APPLICABILITY

The present invention is advantageously applicable to apparatuses using an electric blower, such as a home or industrial electric vacuum cleaner and a hand dryer.

The invention claimed is:

1. An electric blower comprising:

a centrifugal impeller including a hub and a plurality of rotor blades; and an electric motor unit configured to rotate the centrifugal impeller, the hub having a circular outer shape in plan view, the hub comprising:

a central portion protruding in a direction of a rotational axis of the centrifugal impeller; and a surface portion inclined from the central portion toward an outer circumferential portion of the hub, the plurality of rotor blades comprising:

a first rotor blade joined to the surface portion of the hub; and a second rotor blade provided apart from the first rotor blade in a circumferential direction of the hub and joined to the surface portion, the electric blower further comprising a fan cover located outside the plurality of rotor blades in the direction of the rotational axis of the centrifugal impeller to cover the centrifugal impeller, the first rotor blade and the second rotor blade each including:

a lower edge joined to the surface portion of the hub;

an upper edge facing the fan cover; and an inner circumferential edge connecting the upper edge and the lower edge, a distance from the inner circumferential edge of the second rotor blade to the outer circumferential portion of the hub being shorter than a distance from the inner circumferential edge of the first rotor blade to the outer circumferential portion of the hub in a direction along the surface portion, the inner circumferential edge of the second rotor blade including:

a first portion connected to the lower edge;

a second portion connected to the upper edge; and a third portion located between the first portion and the second portion, and among the first portion, the second portion, and the third portion, the first portion being located closest to the outer circumferential portion of the hub in the direction along the surface portion, wherein the first portion is provided more downstream in an air flow direction than the second portion and the third portion, and wherein, in a radial direction perpendicular to the rotational axis, an outermost circumferential portion of the first rotor blade is located outside an outermost circumferential portion of the second rotor blade.

2. The electric blower according to claim 1, wherein, in the radial direction perpendicular to the rotational axis, a distance from the third portion to the surface portion is more than or equal to 0.7 times and less than or equal to 0.8 times a distance from the second portion to the surface portion.

3. The electric blower according to claim 1, wherein an angle formed between a line segment connecting the first portion and the third portion and a plane perpendicular to the rotational axis is less than 90°.

4. An electric vacuum cleaner comprising:

an electric vacuum cleaner main body;

a suction tool joined to the electric vacuum cleaner main body using a pipe line to suck air in a portion to be cleaned;

a dust collecting portion which is provided inside the electric vacuum cleaner main body, is in communication with the suction tool, and stores dust in the sucked air; and the electric blower according to claim 1 provided inside the electric vacuum cleaner main body to suck the air from the suction tool into the dust collecting portion, an exhaust port for exhausting the air subjected to dust collection by the dust collecting portion out of the electric vacuum cleaner main body to outside of the electric vacuum cleaner main body.

5. A hand dryer comprising:

a main body including a hand insertion portion that is an opening into which a user inserts hands; and the electric blower according to claim 1 provided inside the main body, an air inlet through which the electric blower takes in outside air and an air outlet for blowing the outside air sent from the electric blower toward the hand insertion portion being formed in the main body.

* * * * *